United States Patent [19]

Cornwell

[11] 4,003,417

[45] Jan. 18, 1977

[54] SELF LOCKING AND UNLOCKING CLAMP FOR AUTOMATIC FASTENER DRIVING TOOLS

[76] Inventor: Leroy Cornwell, E. 6105 Mansfield, Spokane, Wash. 99211

[22] Filed: July 28, 1975

[21] Appl. No.: 599,674

[52] U.S. Cl. ..... 144/32 R; 145/52; 227/149

[51] Int. Cl.[2] ..... B25B 23/10

[58] Field of Search ..... 144/32; 145/52; 227/149

[56] References Cited

UNITED STATES PATENTS

| | | | |
|---|---|---|---|
| 3,011,534 | 12/1961 | Vilmerding | 144/32 |
| 3,200,863 | 8/1965 | Feldpausch | 144/32 |
| 3,547,169 | 12/1970 | Bangerter | 144/32 |

*Primary Examiner*—Donald R. Schran
*Attorney, Agent, or Firm*—Wells, St. John & Roberts

[57] ABSTRACT

A self locking and unlocking clamp for use in cooperation with an automatic fastener driving tool. The clamp includes a fastener receiving head having a pair of jaw members pivotably mounted thereto. The jaw members are operated to securely hold individual fasteners along their central axes while they are being attached to or driven into a workpiece. A trigger assembly and a cooperating locking assembly is provided on the clamp for (a) locking the jaws together in order to securely hold successive fasteners relative to the tool, and (b) unlocking to enable the jaws to move apart and thereby release successive fasteners once they become securely attached to a workpiece.

8 Claims, 7 Drawing Figures

SELF LOCKING AND UNLOCKING CLAMP FOR AUTOMATIC FASTENER DRIVING TOOLS

BACKGROUND OF THE INVENTION

The present invention is related to automatic fastener driving equipment and more particularly to fastener holding assemblies for such equipment.

It has become a problem in industrial assembly operations to successfully utilize automatic fastener driving equipment without eventually damaging the workpiece due to misalignment of a fastener and misguided force against the automatic driving tool. More specifically, much difficulty has been experienced in the wood fastening field wherein automatic driving tools are utilized to secure wood workpieces together with screws. Ordinarily, screws are fed to an automatic fastener driving tool that is hand held and positioned by an operator. In operation, the screws are fed individually to the automatic driving tool and temporarily held by an expansible pair of jaws to project forwardly from the tool head. Unless the screw is held perpendicular to the workpiece and direct axial force is applied to the tool when starting the screw into the workpiece, the jaws will open and allow the screw to become disengaged from the driving tool, scratch across the surface of the workpiece, and fall to the floor. When this happens, the user seldom has sufficient time to retract the driving tool before it strikes the workpiece and inflicts further damage.

It has therefore been found to be desirable to design a clamp mechanism whereby each automatically fed fastener, such as a screw, may be held securely within the tool along a prescribed axis until it becomes firmly attached to the workpiece. With such a device, inadvertent disengagement of a fastener from the driving tool would be prevented, even though a misaligned force be applied between the driving tool and workpiece.

SUMMARY OF THE INVENTION

A self locking and unlocking fastener clamp is described for use in conjunction with automatic fastener driving tools. The clamp assembly includes a fastener receiving head adapted to be mounted at a forward end of an automatic fastener driving tool. Chuck means is mounted to the fastener receiving head and is movable thereon between (a) a first position for engaging the securely holding a fastener to be operated upon by the driving tool, and (b) a second position for releasing the fastener after being operated on. Locking means is further provided to lock the chuck means in the first position in order to securely hold the fastener while being operated upon. A trigger means is associated with the chuck locking means for unlocking the chuck means from the first position and allowing movement of the chuck means to the second position. A fastener release means enables spreading of the chuck means, when unlocked from the first position, to the second position so a fastener may be completely released from the clamp.

It is a primary object of the present invention to provide a simple clamping device whereby various types of fasteners may be securely held by an automatic driving tool head until being firmly attached to a workpiece.

It is a further object to provide such a clamp that is responsive to positioning of the fastener driving tool relative to a workpiece to release a fastener held thereby.

A still further object is to provide such a clamp that is simple in construction, inexpensive to manufacture, and therefore relatively maintenance free and inexpensive to purchase.

These and yet further objects and advantages will become apparent upon reading the following detailed description, which, taken with the accompanying drawings, disclose a preferred form of the present invention.

DETAILED DESCRIPTION OF A PREFERRED EMBODIMENT

Figure 1:
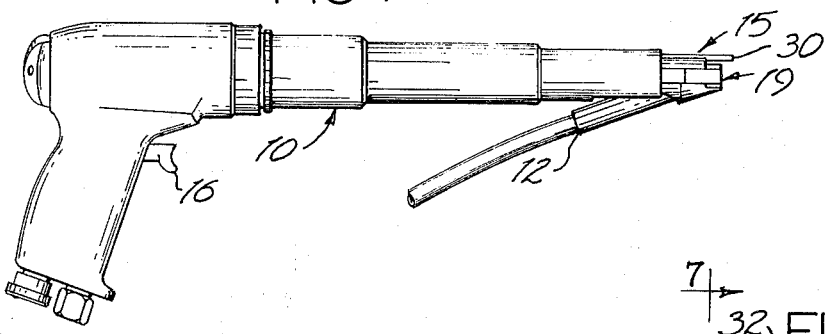
FIG. 1 is a side elevational view of a driving tool and a clamp assembly embodying a preferred form of my invention.
Figure 5:
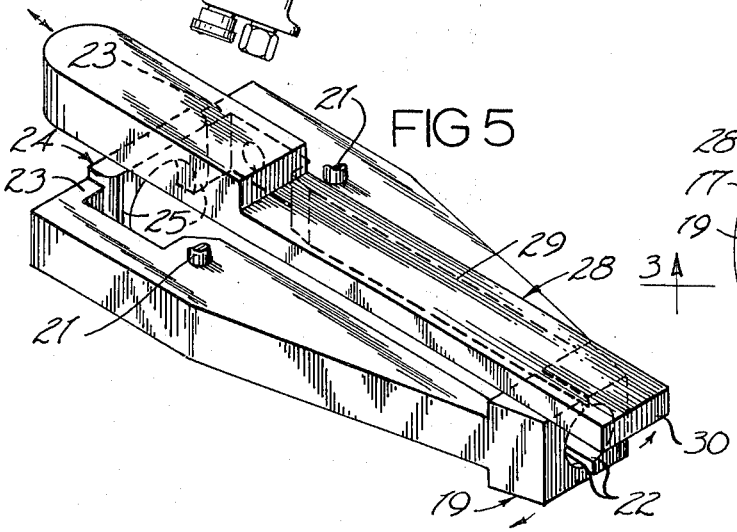
FIG. 5 is a pictorial view of several elements of the present invention showing their operational relationship and configuration.

FIG. 1 exemplifies a preferred form of my invention, incorporating an automatic fastener driving tool 10 and a self-locking and unlocking fastener clamp assembly 15. Tool 10 is utilized to provide driving force for connecting fasteners 11, such as the screws shown in FIGS. 3 and 4, to a workpiece. A fastener supply tube 12 leads to the clamp assembly 15 for delivering fasteners 11 one at a time from a conventional supply source (not shown). The specific tool 10 shown in FIG. 1 uses an air pressure operated motor to drive a "Phillips" type screwdriver head 14 upon actuation of the tool trigger 16. Specific technical details of the tool 10 and its internal working elements are commonly known to those skilled in the design and manufacture of automatic fastener driving tools. Such unnecessary detail will therefore not be discussed in further detail by this specification.

Figure 4:
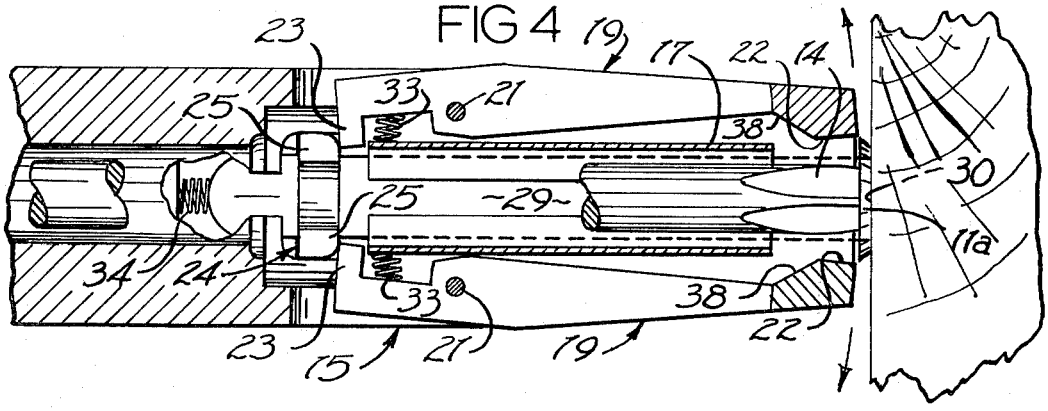
FIG. 4 is a view similar to FIG. 3 only showing a different operational relationship of the clamping elements with regard to a workpiece and fastener.
Figure 6:
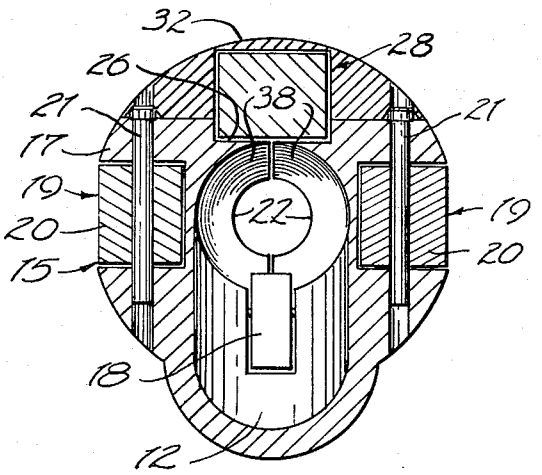
FIG. 6 is an enlarged sectional view taken substantially along line 6—6 in FIG. 3 without showing the screwdriver shank and fastener.
Figure 7:
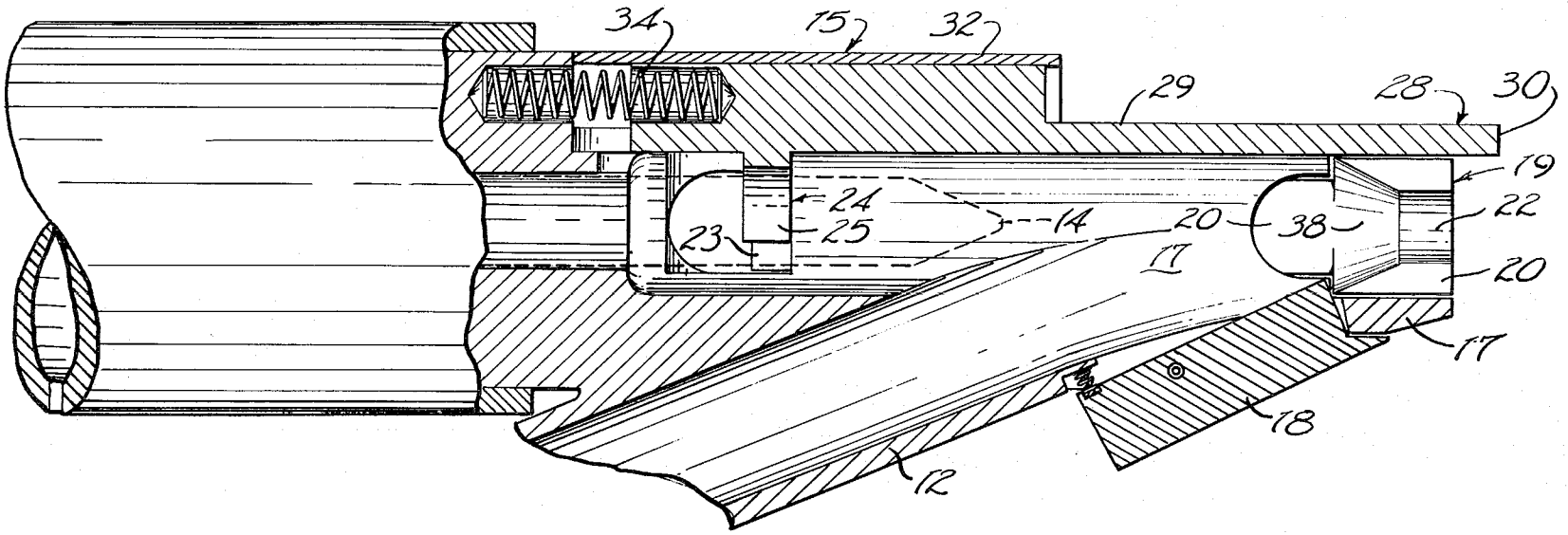
FIG. 7 is an enlarged sectional view taken along line 7—7 in FIG. 2.

The clamping assembly 15 is removably mounted to tool 10 to enable its replacement with other similar assemblies that are adapted to operate upon different size fasteners. The assembly and screwdriver shank are mounted for relative coaxial movement, in response to actuation of trigger 16. When the trigger is pulled, the air motor is operated to turn the screwdriver, and a valve (not shown) is operated to supply air against a piston (also not shown) to move the screwdriver shank and clamping assembly relatively toward each other. This moves the screw 11 and the screwdriver head 14 axially into operative engagement (FIG. 4). When the trigger is released, the screwdriver shank and clamp assembly move axially apart. This inoperative position is shown in FIG. 7 with the screwdriver head 14 (dotted lines) spaced rearwardly of supply tube 12 to permit reception of the next successive screw by clamping assembly 15.

At this time, before entering into a detailed description, a brief and general description of the operations of my invention will be given in order to further develop a better understanding of the present clamp assembly 15. Before operation, a single screw 11 is fed from the supply source through tube 12 and into assembly 15. The screw is received within the assembly and is locked therein against endwise and lateral movement. When the tool trigger 16 is actuated, the assembly 15 and screwdriver move axially together so screwdriver head 14 engages and rotates screw 11. The user then pushes the pointed end of the rotating screw against a workpiece. He maintains an axial forward force against the tool in order to drive the screw into the workpiece. All the while, the present clamp assembly functions to hold the screw in coaxial relationship with the screwdriver shank. As the screw becomes inbedded in the workpiece, a trigger mechanism on the assembly engages the workpiece and unlocks the clamp assembly. This enables the screw to move on forwardly into the workpiece, camming against and thereby separating the previous locked jaws of the assembly (FIG. 4). The screw thereby disengages itself from the assembly and the jaws snap back into the formerly locked position. As the tool is drawn away from the workpiece, the trigger mechanism automatically locks the assembly to receive and lock the next successive screw 11 in place.

Figure 2:
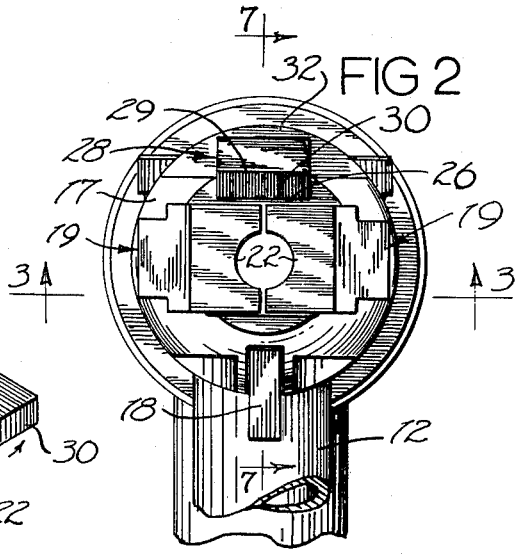
FIG. 2 is an enlarged fragmentary frontal view of the clamp assembly.

Looking at clamp assembly 15 now in greater detail, particular reference will be made to FIGS. 2 through 7. Clamp assembly 15 includes a fastener receiving head 17 that is longitudinally hollow (FIGS. 3, 4 & 7) to slidably receive fasteners 11 from tube 12 and to enable longitudinal axial movement of screwdriver head 14 therein. A spring biased pawl 18 (FIGS. 2 and 7) is pivotably mounted to the fastener receiving head in the path of screws 11 received through supply tube 12. Pawl 18 permits movement of successive screws forwardly within fastener receiving head 17 to a desired operative position (FIG. 2). However, the biased pawl 18 (FIG. 7) locks each screw held in this position against rearward movement within the receiving head 17. The successive screws 11 are also held along their center axes within fastener receiving head 17 by a chuck means 19.

Chuck means 19 includes a pair of jaw members 20 that are mounted by pivot pins 21 (FIG. 6) on opposite sides of the longitudinal axis of a fastener 11 held thereby. Each jaw member 20 includes a concave jaw surface 22 for engaging the screw shank. Jaw surfaces 22 are spaced forwardly of pivot pins 21. Spaced rearwardly from pivot pins 21 are a pair of locking dogs 23. Dogs 23 project toward one another from rearward ends of the jaw members 20. Dogs 23 cooperate with a locking means 24 to securely hold the chuck 19 in a closed, locked condition. A screw held between jaws 20, when the chuck is closed and locked, will not move laterally of its central axis nor can it escape forwardly from between the jaw members. Further, as previously discussed, pawl 18 serves to restrict rearward axial movement of the screw within chuck 19.

Figure 3:
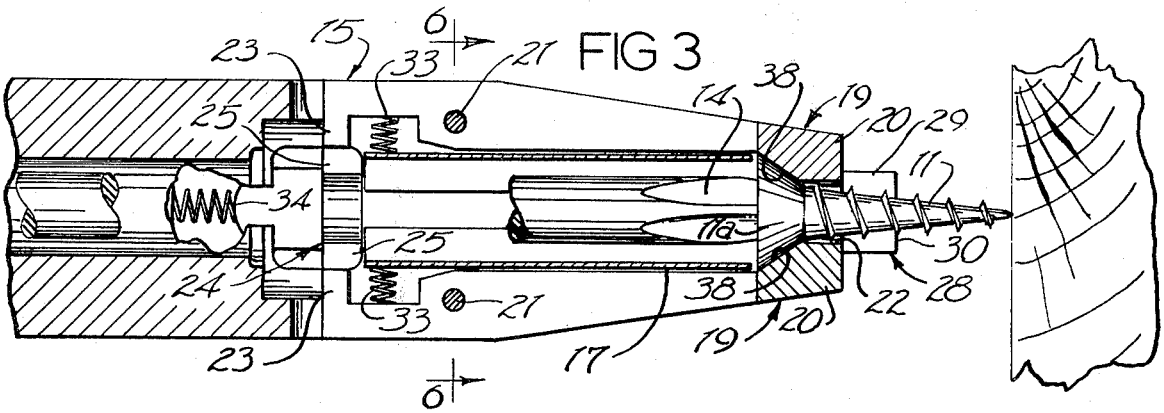
FIG. 3 is a fragmentary sectional view taken along line 3—3 in FIG. 2, and also showing one operational relationship of elements of the present invention with respect to a fastener and workpiece.

Locking means 24 includes a laterally opposed pair of cams 25 mounted within fastener receiving head 17. Cams 25 are mounted for longitudinal sliding movement parallel to the center axis of a screw 11 presently held between jaws 20. Cams 25 are located on opposite sides of screwdriver head 14 and slide between: (1) a first position for engaging and holding dogs 23 in a lateral spaced relationship, thereby locking jaw surfaces 22 together against a fastener 11 (FIG. 3); (2) a second rearwardly spaced position clear of the dogs 23 wherein the chuck is unlocked and is therefore capable of moving to an open fastener releasing position (FIG. 4).

A trigger means 28 is integrally connected with locking means 24. Trigger means 28 is simply comprised of a longitudinal bar 29 that is slidably held within a complementary way 26 formed in head 17. Bar 29 extends forwardly to a protruding workpiece engaging end 30. End 30 is spaced a prescribed distance forwardly from the forwardmost end of fastener receiving head 17, but rearward of the pointed fastener end held between jaws 20. Forward spacing of end 30 facilitates engagement of the trigger mechanism 28 and workpiece prior to similar engagement by the forward end of head 17. The bar 29 and cams 25 are biased forwardly by means of a spring 34 (FIGS. 3 and 7) connected between bar 29 and fastener receiving head 17. A forward abutment 31 is provided on receiving head 17 to restrict forward movement of bar 29 as urged by spring 34. A cover plate 32 (FIG. 2) is also provided to loosely enclose bar 29 and cams 25 within fastener receiving head 17.

Jaw members 20 are continuously biased toward a closed condition as shown in FIGS. 2 and 3 by means of a pair of compression springs 33 (FIGS. 3 and 4). Springs 33 are mounted between jaw members 20 and housing 17. They are located rearward of pivot pins 21 so that regardless of the position of locking means 24, the jaw members 20 are continuously urged toward the closed position.

Locking means 24 assures that the fastener 11 will not be released from the tool regardless of lateral force applied to the fastener relative to the central fastener axis while it is held between the closed and locked jaws 20. However, when cams 25 and locking dogs 23 are disengaged, jaws 20 are held closed only by the force applied by springs 33.

The fastener is released from the unlocked chuck 19 as the forwardly moving screwhead 11a cams against a pair of opposed cam surfaces 38 on jaws 20. The paired surfaces 38 (FIGS. 3, 4, 6 & 7) are formed integrally within jaw members 20 adjacent jaw surfaces 22. Cam surfaces 38 diverge rearwardly with respect to adjacent jaw surfaces 22. The head portion of a fastener, as it moves into a workpiece, will engage the cam surfaces 38. As the screw length becomes imbedded in the workpiece, camming action of the forwardly moving screwhead 11a against surfaces 38 will force the jaws 20 apart. This movement, of course, may occur only when trigger means 28 has been operated to unlock the closed jaw members 20 from the locked first position.

In operation, a single fastener 11 is delivered from the source to the receiving head 17 through supply tube 12. The fastener is received and locked within head 17 forwardly of escapement pawl 18. The fastener is further locked against lateral movement within the assembly 15 between the closed, locked jaw surfaces 22 of chuck 19. The jaw surfaces 22 hold fastener 11 along its center axis coaxial with the axis of the screwdriver shank. When held thus by the assembly 15, the pointed end of fastener 11 protrudes forwardly of the trigger bar end 30 (FIG. 2).

In order to drive the fastener 11 into a workpiece, the user first presses the tool trigger 16 to move the fastener and screwdriver axially into engagement. The fastener 11 then rotates about its central axis between jaw surfaces 22. Because the jaw surfaces are locked together in the closed position, any lateral force applied against the screw tip, whether accidental or intentional, will not result in release of the fastener from between jaws 20 (FIG. 3). Only forward axial movement of screw 11 into the workpiece can result in movement of the jaw members to an open position.

The user holds the rotating fastener against a workpiece and applies a continuous forward force axially along the coaxial screwdriver shank and screw 11. As screw 11 becomes inbedded in the workpiece, trigger bar end 30 comes into contact against the workpiece surface. The bar 29 will therefore remain stationary, in abutment with the workpiece while fastener receiving head 17 and screw 11 continue forward movement toward the workpiece. Relative longitudinal movement of head 17 and trigger means 28 results in disengagement of cams 25 and locking dogs 23. As this happens, the chuck 19 becomes unlocked and the jaws 20 become capable of separating to release the partially imbedded screw. The unlocked jaw members 20 may then be separated as the forwardly moving fastener head slides against cam surfaces 38 and subsequently over jaw surfaces 22 (FIG. 4). This forward axial movement forces the spring biased jaw members apart to allow complete disengagement of the fastener from the clamp assembly.

Once the screw becomes completely imbedded in the workpiece and the screwhead moves clear of chuck 19, the jaws 20 will snap back to the closed position. After this happens, the user may move the tool away from the workpiece and imbedded screw 11, allowing spring 34 to push the trigger bar end 30 back to its forward position. This results in operative engagement of the cams 25 and dogs 23 to lock the chuck 19 in the closed position. At this time, another screw may be fed automatically to the empty clamp and initiate the next operational cycle.

It should be noted that the above description is given only by way of example to set forth the preferred form of the present invention. It is well understood that a similar apparatus within the scope of the present invention may be utilized for the purpose of attaching fasteners other than screws to a workpiece. By incorporating obvious modifications, for example, the apparatus may be utilized to automatically thread nut fasteners to threaded screw shanks or studs. Therefore, it is intended that only the following claims be taken as definitions of may invention.

What I claim is:

1. A self locking and unlocking fastener clamp assembly for automatic fastener driving tools, comprising:

a fastener receiving head adapted to be mounted to a forward end of an automatic fastener driving tool;

chuck means mounted to said fastener receiving head and movable thereon between (a) a first position for engaging and securely holding a fastener to be operated on by the driving tool and (b) a second position for releasing the fastener following operation of the driving tool;

locking means for locking the chuck means in said first position;

trigger means associated with said locking means for unlocking the chuck means from the first position; and fastener release means responsive to forward movement of the fastener along its center axis relative to said chuck means for spreading said chuck means when unlocked from said first position to said second position to release the fastener held thereby;

said chuck means comprising:

a pair of jaw members pivotably mounted to said fastener receiving head on opposite sides of said fastener receiving head;

facing jaw surfaces at forward ends of said jaw members;

facing locking dogs at rearward ends of said jaw members for operative engagement with said locking means;

said jaw surfaces and locking dogs being spaced longitudinally on opposite sides of the pivot axes of said jaw members; and biasing means interconnecting said jaw members and said fastener receiving housing for normally urging said jaw surfaces together.

2. The clamp assembly as recited by claim 1 wherein said locking means is comprised of:

a longitudinally slidable cam mounted to the fastener receiving head for translational forward and backward movement along said fastener receiving head; and wherein said locking dogs are spaced laterally apart when said chuck means is in said first position to receive and engage opposite sides of said slidable cam.

3. The clamp assembly as recited by claim 2 wherein said trigger means comprises:

a bar projecting forwardly from said longitudinally slidable cam to an end forward of said fastener receiving head;

biasing means between said bar and fastener receiving head for urging said bar and slidable cam forwardly; and wherein said forward bar end is spaced forwardly from the fastener receiving head so it will engage a workpiece during operation and remain longitudinally stationary as said fastener receiving head moves forwardly disengaging said locking dogs and slidable cam to thereby unlock said chuck means from said first position.

4. The clamp assembly as recited by claim 1 wherein said fastener release means is comprised of:

cam means on at least one of said jaw members responsive to forward movement of a fastener relative to said chuck means for opening said chuck means to said second position from an unlocked first position.

5. In an automatic fastener driving tool wherein fasteners are automatically fed to a fastener driving head, a self locking and unlocking fastener clamp assembly, comprising:

a fastener receiving head adapted to be mounted to said fastener driving head for receiving successive fasteners therein;

chuck means mounted to said fastener receiving head and movable thereon between (a) a first position for engaging and securely holding a fastener along its center axis and (b) a second position for releasing the fastener;

locking means for locking the chuck means in said first position;

trigger means associated with said locking means for unlocking the chuck means from the first position; and fastener release means for opening said chuck means when unlocked, from said first position to said second position to release the fastener held thereby;

a pair of jaw members pivotably mounted on opposite sides of said fastener receiving head;

facing jaw surfaces at forward ends of said jaw members;

facing locking dogs at rearward ends of said jaw members for operative engagement with said locking means;

said jaw surfaces and locking dogs being spaced longitudinally on opposite sides of the pivot axes of said jaw members; and biasing means interconnecting said jaw members for normally urging said facing jaw surfaces together.

6. The assembly as recited by claim 5 wherein said locking means is comprised of:

a longitudinally slidable cam mounted to the fastener receiving head for translational forward and backward movement thereon; and wherein said facing locking dogs are spaced laterally apart, when said chuck means is in said first position, to receive and engage opposite sides of said slidable cam.

7. The assembly as recited by claim 6 wherein said trigger means comprises:

a bar projecting forwardly from said longitudinally slidable cam to an end forward of said fastener receiving head;

biasing means between said bar and fastener receiving head for urging said bar and slidable cam forwardly; and wherein said forward bar end is spaced forwardly from the fastener receiving head so it will engage a workpiece during operation and remain longitudinally stationary as said fastener receiving head moves forwardly, disengaging said locking dogs and slidable cam to thereby unlock said chuck means from said first position.

8. The assembly as recited by claim 5 wherein said fastener release means is comprised of:

cam means on at least one of said jaw members responsive to forward movement of a fastener relative to said chuck means for opening said chuck means to said second position from an unlocked first position.

* * * * *